US011649576B2

(12) United States Patent
Gupta

(10) Patent No.: US 11,649,576 B2
(45) Date of Patent: May 16, 2023

(54) NEEDLE THREADING AID

(71) Applicant: DPG USA Inc., Schaumburg, IL (US)

(72) Inventor: Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 396 days.

(21) Appl. No.: 16/936,497

(22) Filed: Jul. 23, 2020

(65) Prior Publication Data

US 2021/0025093 A1 Jan. 28, 2021

Related U.S. Application Data

(60) Provisional application No. 62/878,580, filed on Jul. 25, 2019.

(51) Int. Cl.

| | |
|---|---|
| ***D05B 87/02*** | (2006.01) |
| ***B26B 27/00*** | (2006.01) |
| ***B26B 29/00*** | (2006.01) |

(52) U.S. Cl.

CPC ..... *D05B 87/02* (2013.01); *B26B 27/00* (2013.01); *B26B 29/00* (2013.01)

(58) Field of Classification Search

CPC ..... D05B 87/00; D05B 87/02; B26B 27/00; B26B 29/00; A01K 91/04

USPC ..... D22/149

See application file for complete search history.

(56) References Cited

U.S. PATENT DOCUMENTS

| | | | | | |
|---|---|---|---|---|---|
| 1,144,504 | A * | 6/1915 | Schneider | D05B 87/00 | 223/99 |
| 1,239,270 | A * | 9/1917 | Hawks | D05B 87/00 | 223/99 |
| 2,059,680 | A * | 11/1936 | Carlson | D05B 87/00 | 223/99 |
| 2,757,837 | A * | 8/1956 | Dritz | D05B 87/00 | 223/99 |
| 3,004,691 | A * | 10/1961 | Prock | D05B 91/14 | 223/99 |

FOREIGN PATENT DOCUMENTS

| | | | |
|---|---|---|---|
| AT | 001505 U1 | * | 6/1997 |
| AT | 005283 U2 | * | 5/2002 |

* cited by examiner

*Primary Examiner* — Ismael Izaguirre
(74) *Attorney, Agent, or Firm* — Dunlap Bennett & Ludwig, PLLC; Anna L. Kinney

(57) ABSTRACT

A needle threading aid has a graspable body with a threading ledge on its upper surface, with a threading aperture formed through the threading ledge, a ridge is formed next to the threading aperture, the ridge has a collapsible wire loop over the threading aperture, the wire loop has a generally angular return bend, the wire loop is passable through the eye of a needle.

18 Claims, 7 Drawing Sheets

Figure 2
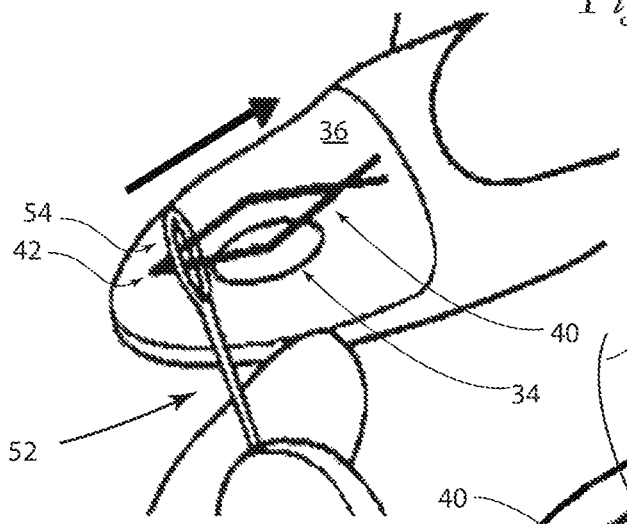
Figure 3
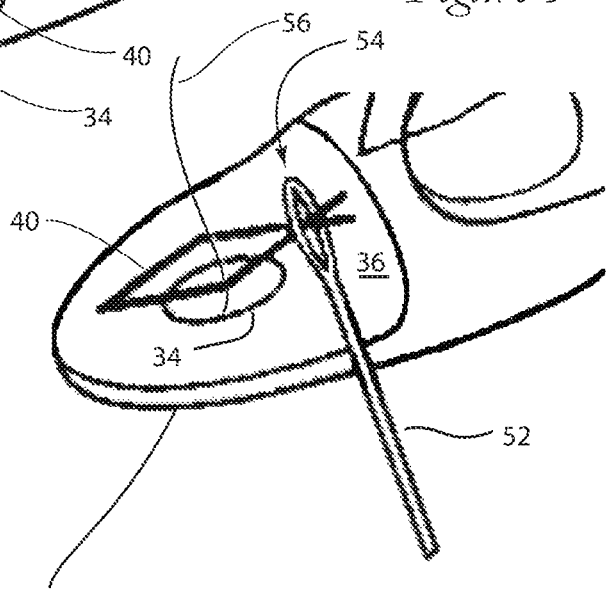
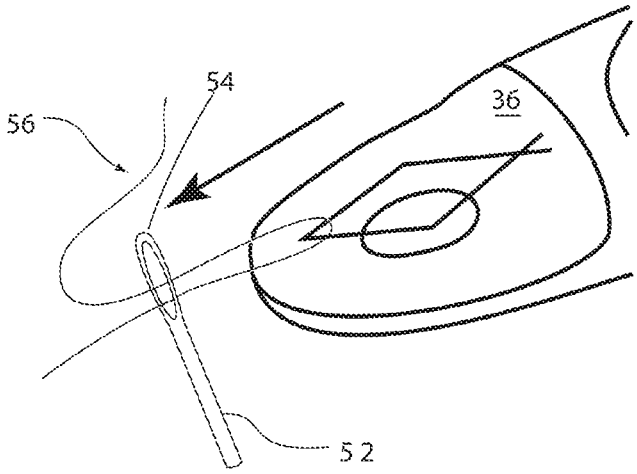
Figure 4

*Figure 5*
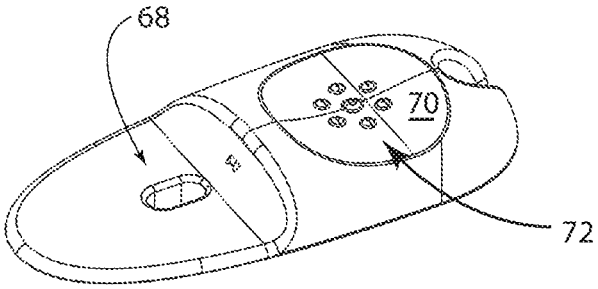
*Figure 6*
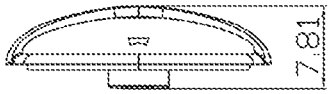
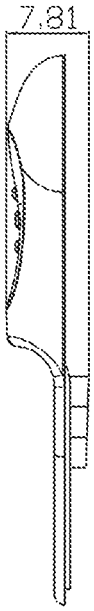
*Figure 7*
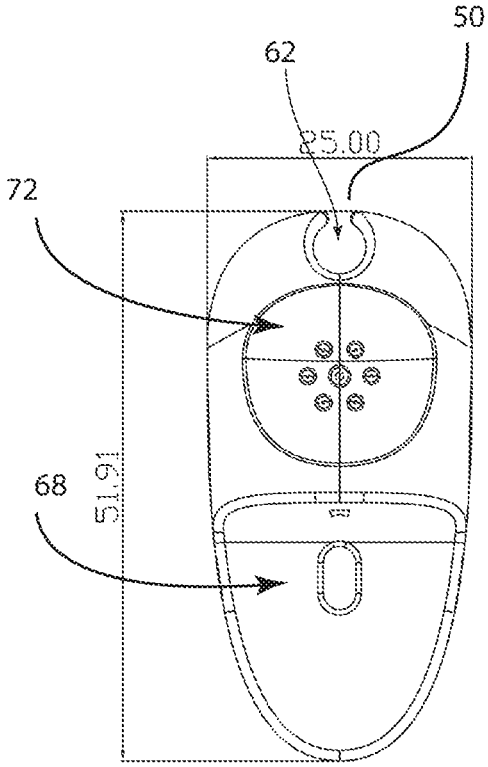
*Figure 8*

Figure 9
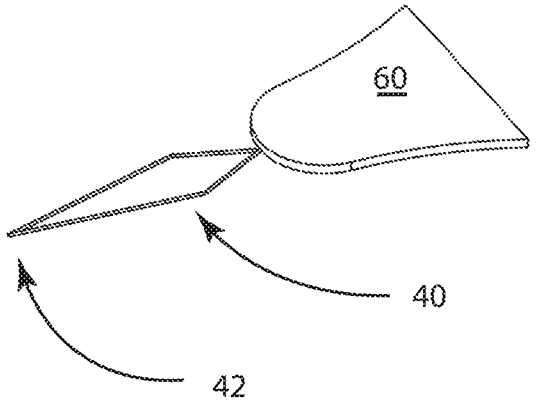
Figure 10
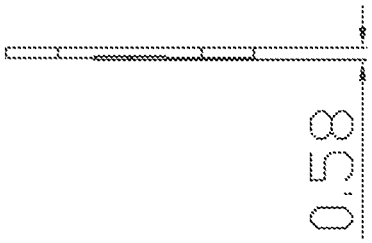
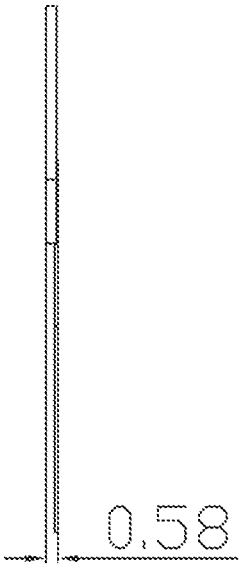
Figure 11
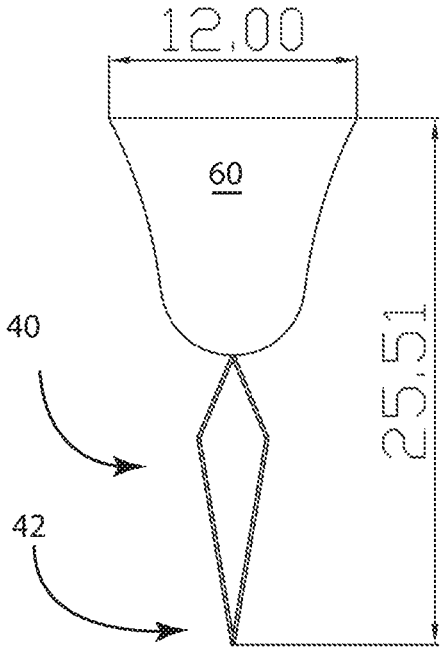
Figure 12

Figure 13
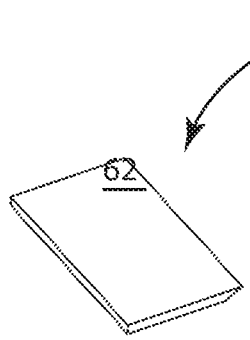
Figure 14
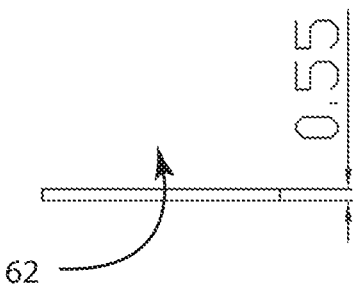
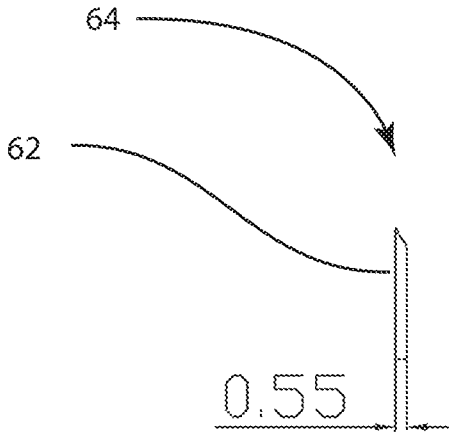
Figure 15
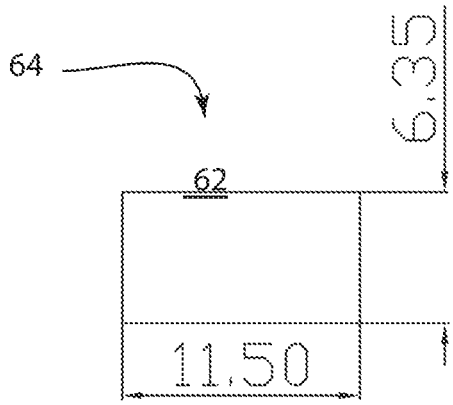
Figure 16

Figure 17
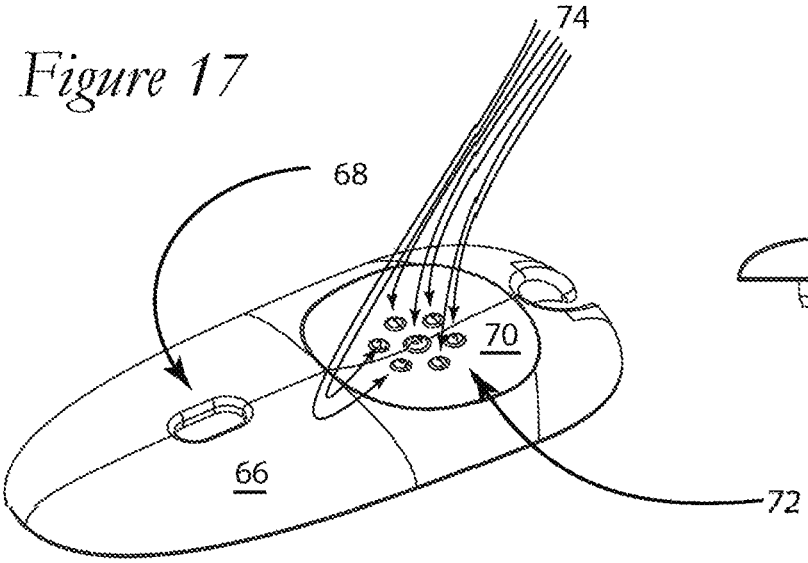
Figure 18
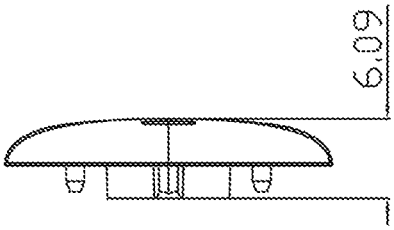
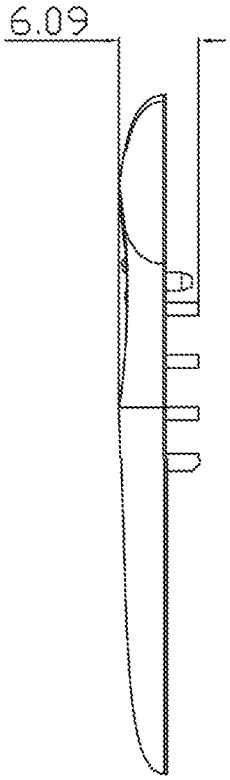
Figure 19
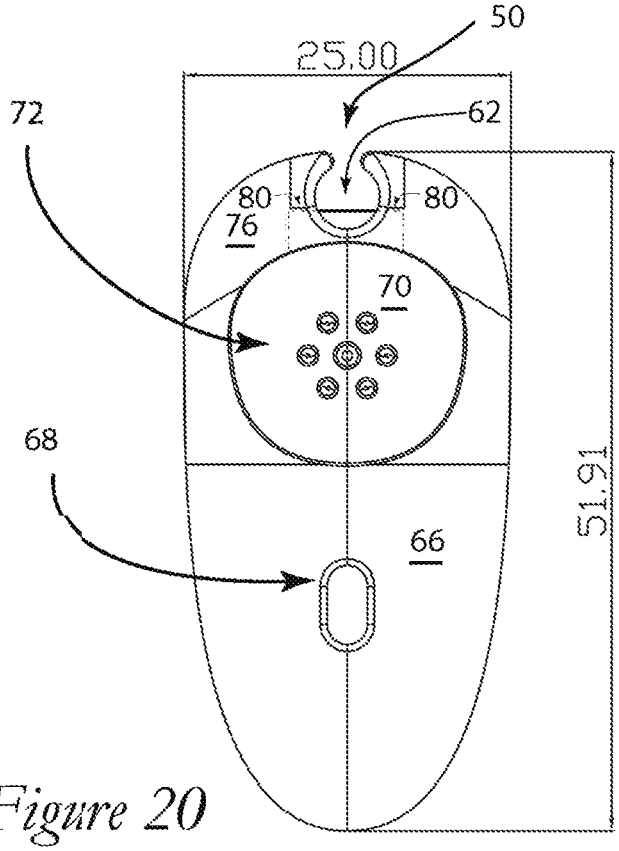
Figure 20

NEEDLE THREADING AID

This application claims priority of U.S. Provisional Application 62/878,580 filed Jul. 25, 2019, entitled Needle Threading Aid which is incorporated by reference herein in its entirety.

Sewing has been accomplished using needle and thread for thousands of years, yet a perplexing issue remains to trouble those who merely wish to take a first step into sewing—passing the thread through the eye of the needle. As technology for forming needles has advanced and finer needles and finer threads are used for sewing, the difficulty of threading the needle has increased, so that even those with quite good vision and good coordination will often require more than one pass to achieve a threaded needle.

A variety of devices have been developed often involving various permutations of magnifying lenses, auxiliary lighting, grasping devices and intermediary devices for holding the needle or thread to ease the critical step of introducing the thread into the eye of the needle. Of course, magnifying lenses are subject to scratching and Murphy's law suggests that battery power for auxiliary lighting will generally fail when most needed while larger devices will tend not to find a permanent home in the sewing bag as they can become inconveniently large considering everything else that we all too often find it necessary to carry.

SUMMARY OF THE INVENTION

The device of the present invention addresses this problem by providing a compact device which requires neither magnification nor auxiliary lighting and can conveniently be carried in even the smallest of sewing bags.

In particular, I address this problem by providing a needle threading aid, having: a graspable body with a generally planar threading ledge formed adjacent one end of the graspable body, a threading aperture extending through the threading ledge, a ridge formed adjacent the threading aperture, the ridge having a collapsible wire loop projecting therefrom extending over said threading aperture, the ridge being medially disposed in the graspable body, the graspable body comprising a thickened portion between the ridge and the other end of the graspable body, the wire loop having a generally angular return bend formed therein, with a pair of grasping depressions formed on opposed surfaces of the graspable body, the grasping depressions being formed in the thickened portion of the body disposed between the ridge and another end of the graspable body.

BRIEF DESCRIPTION OF THE DRAWINGS

FIGS. 2-4 are schematic isometric perspectives of one end of the threading aid of the present invention illustrating use thereof.

FIG. 5-8 are an isometric perspective of the upper shell of the threading aid of the present invention along with an end elevation, a side elevation and a plan view respectively.

FIGS. 9-12 are an isometric perspective of the insertion wire and the retaining plate therefor of the threading aid of the present invention along with an end elevation, a side elevation and a plan view respectively.

FIGS. 13-16 are an isometric perspective of the cutting blade of the threading aid of the present invention along with an end elevation, a side elevation and a plan view respectively.

FIGS. 17-20 are an isometric perspective of the lower shell of the threading aid of the present invention along with an end elevation, a side elevation and a plan view respectively.

In FIG. 1, threading aid 30 has planar threading ledge 32 formed in one end thereof with threading aperture 34 passing therethrough adjacent ridge 36 having wire aperture 38 therein adjacent threading aperture 34 with wire insertion loop 40 having angular return bend 42 formed therein with loop 40 extending over threading aperture 34. Thickened portion of threading aid 30 has grasping depression 44 formed therein with grip enhancing surfaces 46 defined therein in the form of protrusions 48 extending upwardly therefrom. Cutting aperture 50 is formed in the other end of threading aid 30.

In FIG. 2, needle 52 having eye 54 formed therein has angular return bend 42 of wire loop 40 passing through eye 54 with needle 52 being urged toward ridge 36. Preferably wire loop 40 is comprised of annealed stainless steel wire having a diameter of less than about 0.25 mm, more preferably less than about 0.20 mm and most preferably about 0.15 mm. In FIG. 3, eye 54 of needle 52 has been passed inwardly toward ridge 36 allowing wire loop 40 to open so that thread 56 may pass through wire loop 40 and threading aperture 34. In FIG. 4, needle 52 has been passed outwardly away from ridge 36 over return bend so that thread 56 is now passing through eye 54 of needle 52. Preferably planar threading ledge 32, and most preferably the upper surface of threading aid 30 will be of a color contrasting with the color of wire loop 40. In the most preferred embodiment the entirety of threading aid 30 will be a color contrasting to the color of wire loop 40 to facilitate ready discernment thereof by the user.

In FIGS. 5-8, upper shell 58 of threading aid 30 is displayed with cutting aperture 50 being visible therein.

In FIGS. 9-12, wire 40 having angular return bend 42 therein is embedded in retention plate 60.

In FIGS. 13-16, cutting blade 62 has cutting edge 64 formed thereupon.

In FIGS. 17-20, lower shell 66 of threading aid 30 has aperture 68 formed therein, aperture 68 being mateable with aperture 34 formed in upper shell 58. Lower grasping depression 70 has grip enhancing surfaces 72 taking the form of protrusions 74 formed therein. Cutting aperture 50 is visible at upper end 76 of lower shell 66 with rearward retaining wall 80 for cutting blade 62 visible in phantom.

In FIGS. 21-24, upper shell 58 is disposed above lower shell 66 with insertion wire 40 and retention plate 60 as well as cutting blade 62 disposed therebetween.

Figure 1:
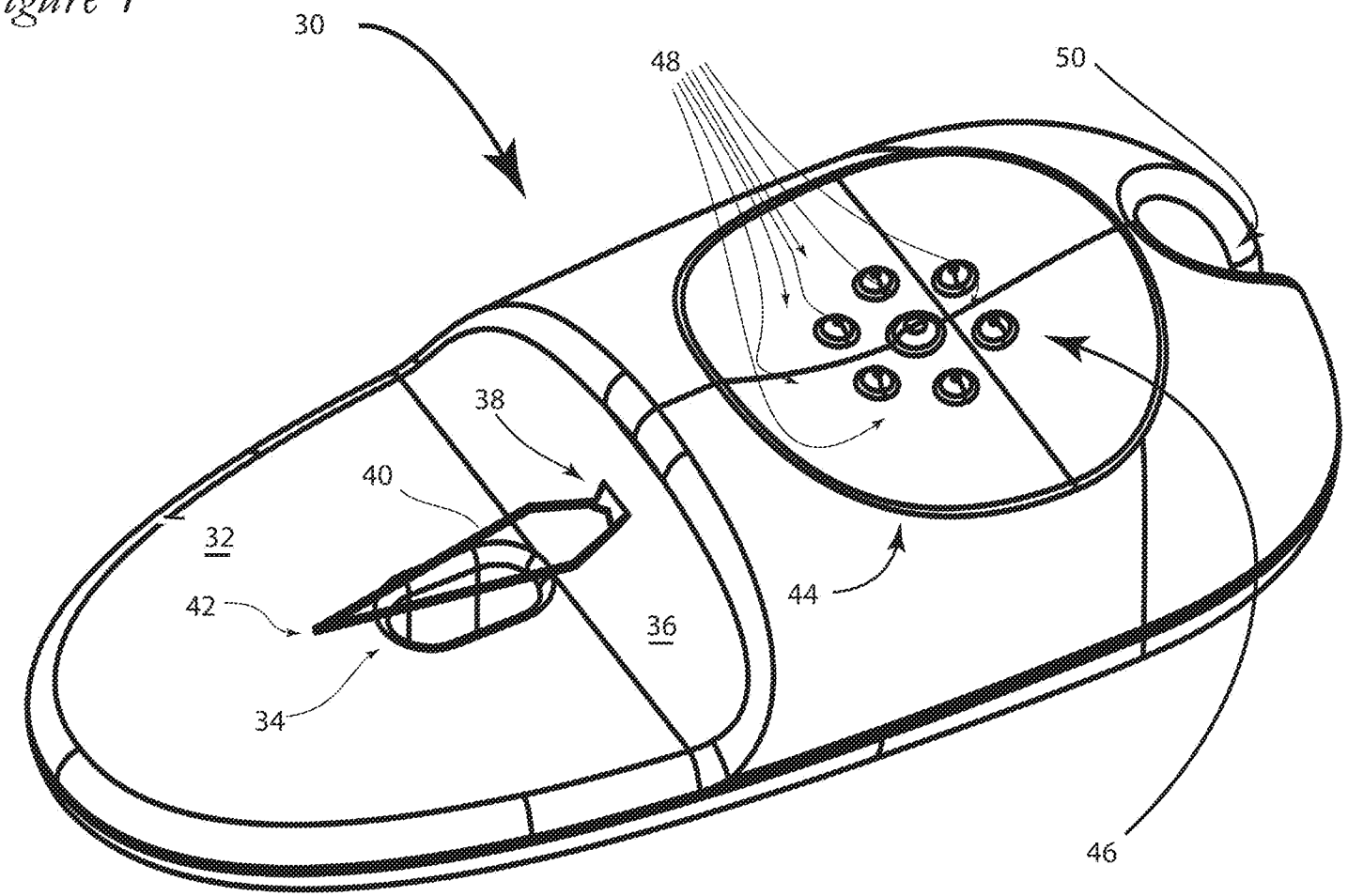
FIG. 1 is a schematic isometric perspective of the threading aid of the present invention in the assembled form.
Figures 21, 22, 23, 24:
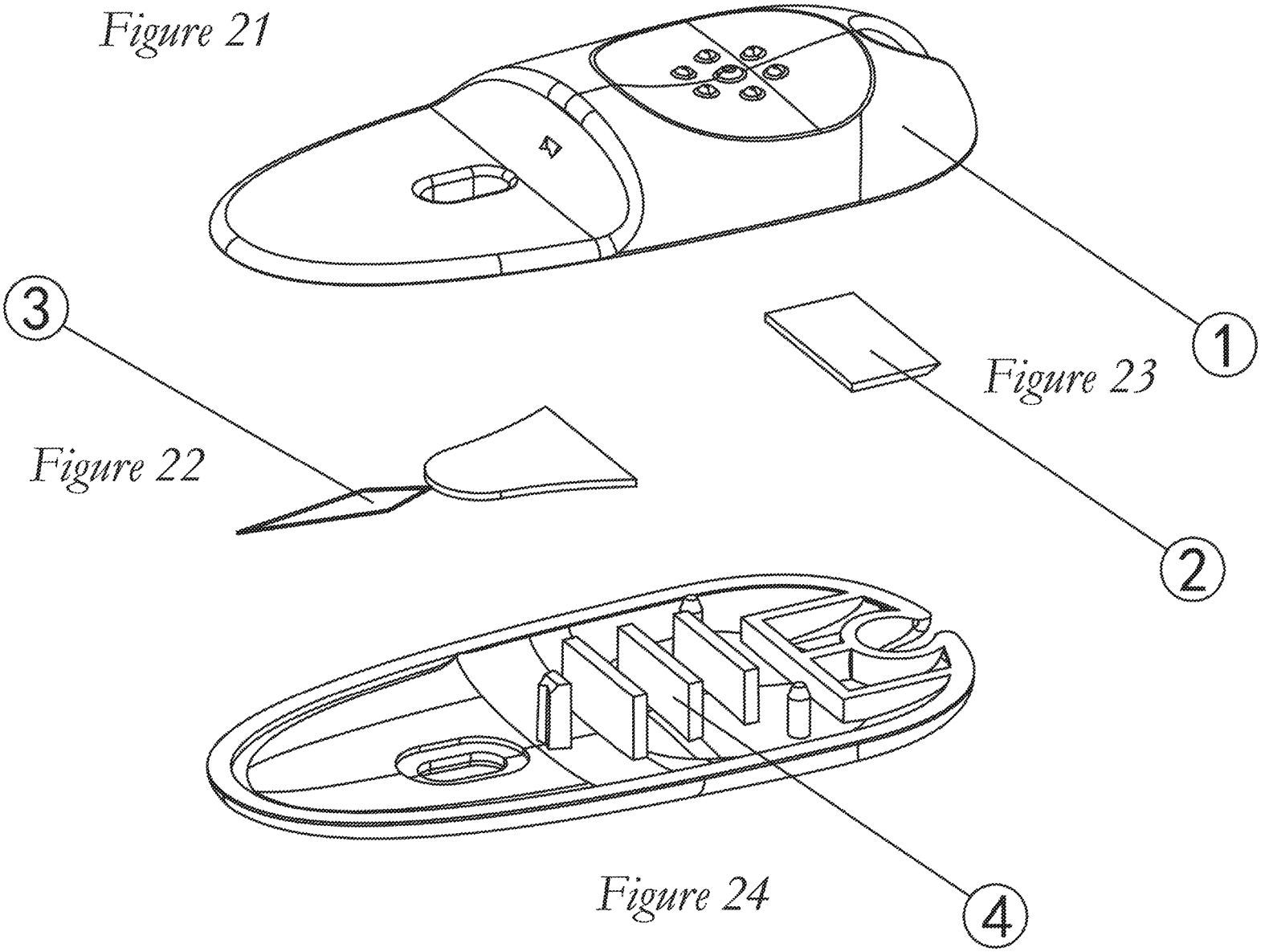
FIGS. 21-24 are isometric perspectives of the upper shell, insertion wire and retaining plate therefor, the cutting blade and the lower shell of the threading aid of the present invention, disposed on the page so as illustrate the assembly thereof.

As my invention, I claim:

1. A needle threading aid, comprising: a graspable body having a threading ledge formed thereupon, a threading aperture extending through said threading ledge, a ridge formed adjacent said threading aperture, said ridge having a collapsible wire loop projecting therefrom extending over said threading aperture, said wire loop having a generally angular return bend formed therein, said wire loop being configured to be passable through the eye of a needle; wherein a cutting notch is formed in a peripheral portion of said graspable body, said cutting notch having a blade disposed therein.

2. The needle threading aid of claim 1, wherein a pair of grasping depressions are formed on opposed surfaces of said graspable body.

3. The needle threading aid of claim 2, wherein said threading ledge is formed adjacent one end of said graspable body.

4. The needle threading aid of claim 3, wherein said ridge is medially disposed in said graspable body.

5. The needle threading aid of claim 4, wherein said graspable depressions are formed between said ridge and another end of said graspable body.

6. The needle threading aid of claim 5, wherein said graspable body comprises a thickened portion between said ridge and said other end of said graspable body, said grasping depressions being formed in said thickened portion of said graspable body.

7. The needle threading aid of claim 6, wherein said threading ledge is generally planar.

8. The needle threading aid of claim 7, wherein said ridge extends substantially across the width of said graspable body.

9. The needle threading aid of claim 8, wherein said ridge adjoins said threading ledge and extends upwardly adjoining said thickened portion.

10. The needle threading aid of claim 1, wherein said blade is recessed in said cutting notch such that a human finger pressed against said cutting notch will not contact said blade.

11. The needle threading aid of claim 10, wherein said cutting notch extends generally rectilinearly between opposed surfaces of said thickened portion, forming an enlarged cutting aperture spaced from said periphery of said graspable body, said cutting notch being of reduced width as compared to said cutting aperture.

12. The needle threading aid of claim 11, wherein said cutting aperture is generally circular in cross section and said notch has a width less than about 3 mm whilst said blade is spaced away from said periphery by a distance of at least 3 mm.

13. A needle threading aid, comprising: a graspable body having a generally planar threading ledge formed adjacent one end of said graspable body, a threading aperture extending through said threading ledge, a ridge formed adjacent said threading aperture, said ridge having a collapsible wire loop projecting therefrom extending over said threading aperture, said ridge being medially disposed in said graspable body, said graspable body comprising a thickened portion between said ridge and said other end of said graspable body, said wire loop having a generally angular return bend formed therein, wherein a pair of grasping depressions are formed on opposed surfaces of said graspable body, said graspable depressions being in said thickened portion of said graspable body formed between said ridge and another end of said graspable body.

14. The needle threading aid of claim 13 wherein said wire loop is comprised of stainless steel having a diameter of less than about 0.25 mm.

15. The needle threading aid of claim 13 wherein said wire loop is comprised of annealed stainless steel having a diameter of less than about 0.25 mm.

16. The needle threading aid of claim 13 wherein said wire loop is comprised of annealed stainless steel having a diameter of less than about 0.20 mm.

17. The needle threading aid of claim 13 wherein said wire loop is comprised of annealed stainless steel having a diameter of less than about 0.17 mm.

18. The needle threading aid of claim 13 wherein said wire loop is comprised of annealed stainless steel having a diameter of about 0.15 mm.

* * * * *